US012325939B2

(12) United States Patent
Choi et al.

(10) Patent No.: US 12,325,939 B2
(45) Date of Patent: Jun. 10, 2025

(54) SPUNBONDED NONWOVEN FABRIC AND TILE CARPET USING THE SAME

(71) Applicant: KOLON INDUSTRIES, INC., Seoul (KR)

(72) Inventors: Woo-seok Choi, Seoul (KR); Min-ho Lee, Seoul (KR); Hee-jung Cho, Seoul (KR); Young-shin Park, Seoul (KR); Jung-soon Jang, Seoul (KR)

(73) Assignee: KOLON INDUSTRIES, INC., Seoul (KR)

( * ) Notice: Subject to any disclaimer, the term of this patent is extended or adjusted under 35 U.S.C. 154(b) by 281 days.

(21) Appl. No.: 17/905,937

(22) PCT Filed: Feb. 19, 2021

(86) PCT No.: PCT/KR2021/002131
§ 371 (c)(1),
(2) Date: Sep. 8, 2022

(87) PCT Pub. No.: WO2021/201430
PCT Pub. Date: Oct. 7, 2021

(65) Prior Publication Data

US 2023/0139097 A1 May 4, 2023

(30) Foreign Application Priority Data

Mar. 31, 2020 (KR) ..... 10-2020-0039114
Feb. 18, 2021 (KR) ..... 10-2021-0022107

(51) Int. Cl.
*D04H 3/16* (2006.01)
*D04H 3/011* (2012.01)

(52) U.S. Cl.
CPC ..... *D04H 3/16* (2013.01); *D04H 3/011* (2013.01); *D10B 2401/063* (2013.01);
(Continued)

(58) Field of Classification Search
CPC ..... D04H 3/16; D04H 3/011; D04H 3/153; D10B 2401/063; D10B 2503/041; A47G 27/02
See application file for complete search history.

(56) References Cited

U.S. PATENT DOCUMENTS 4,418,116 A * 11/1983 Scott ..... D01F 6/84 428/401
2011/0162778 A1 7/2011 Suzuka

FOREIGN PATENT DOCUMENTS

CN 1411520 A 4/2003
CN 101532211 A 9/2009
(Continued)

OTHER PUBLICATIONS

International Search Report.

*Primary Examiner* — Elizabeth M Imani
(74) *Attorney, Agent, or Firm* — Harvest IP Law, LLP

(57) ABSTRACT

The present disclosure relates to a spunbond nonwoven fabric for a base fabric for tile carpet which not only has excellent spinnability during the production of nonwoven fabric and improves tensile strength and tensile elongation, and has the effect of recycling waste such as polyester plastic, by using recycled polyester with optimized intrinsic viscosity, crystallization temperature, and number of foreign matters as a raw material, and a tile carpet using the same.

8 Claims, 1 Drawing Sheet

(52) U.S. Cl.
CPC ..... *D10B 2503/041* (2013.01); *Y10T 442/681* (2015.04); *Y10T 442/697* (2015.04)

(56) References Cited

FOREIGN PATENT DOCUMENTS

| | | | | |
|---|---|---|---|---|
| CN | 102168320 | A | | 8/2011 |
| CN | 103755933 | A | | 4/2014 |
| CN | 106757518 | A | | 5/2017 |
| FR | 1254635 | A | | 2/1961 |
| GB | 1320399 | A | | 6/1973 |
| JP | H1072725 | A | | 3/1998 |
| JP | 2002194653 | A | | 7/2002 |
| JP | 2002-345624 | A | | 12/2002 |
| JP | 2014509530 | A | | 4/2014 |
| JP | 2015010294 | A | | 1/2015 |
| KR | 10-0544992 | B1 | | 1/2006 |
| KR | 10-2010-0071292 | A | | 6/2010 |
| KR | R10-2012-0075117 | A | | 7/2012 |
| KR | 2015-0035138 | A | | 4/2015 |
| KR | 20150074374 | A | * | 7/2015 |
| KR | 10-2016-0079347 | A | | 7/2016 |
| KR | 10-1976119 | B1 | | 5/2019 |
| KR | 10-2037496 | B1 | | 10/2019 |
| KR | 10-2061805 | B1 | | 1/2020 |
| WO | 2019-009539 | A2 | | 1/2019 |

* cited by examiner

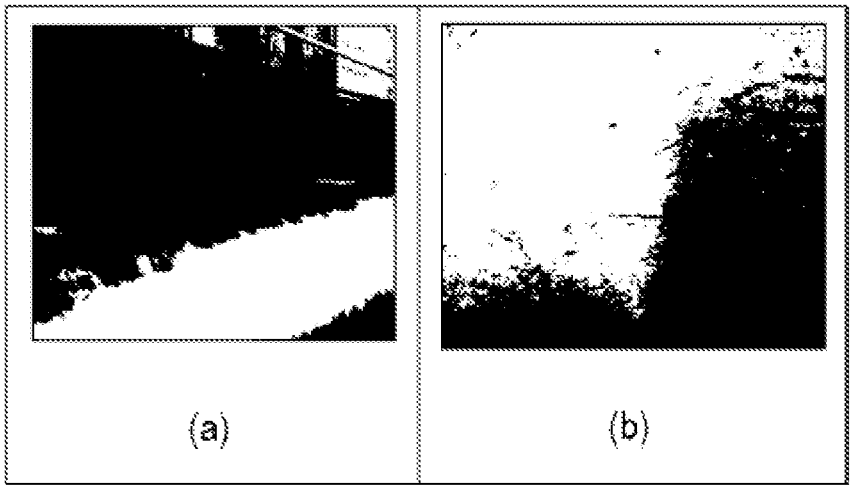
(a)
(b)

SPUNBONDED NONWOVEN FABRIC AND TILE CARPET USING THE SAME

TECHNICAL FIELD

Cross Reference to Related Application(s)

This application is a National Stage of International Application No. PCT/KR2021/002131 on Feb. 19, 2021 claiming the benefit of Korean Patent Application No. 10-2020-0039114 filed on Mar. 31, 2020 and Korean Patent Application No. 10-2021-0022107 filed on Feb. 18, 2021 with the Korean Intellectual Property Office, the disclosures of which are incorporated herein by reference in their entirety.

The present disclosure relates to a spunbond nonwoven fabric that can be applied as a base fabric for tile carpet exhibiting high functionality, and a tile carpet using the same.

BACKGROUND ART

Nonwoven fabric is a product made by arranging filaments in a planar form, and is largely divided into a staple fiber nonwoven fabric and a long fiber nonwoven fabric according to the length of the filament. The staple fiber nonwoven fabric is a product made by arranging staple fibers of 5 mm or less in a planar form, and subjecting them to entanglement between fibers or resin adhesion, and has a feature of high elongation. The long fiber nonwoven fabric is a product made by arranging unbroken fibers in a planar shape and subjecting them to entanglement between fibers or resin adhesion, and has a feature of high strength.

Long-fiber nonwoven fabric, which has advantages such as excellent strength, is mainly used for construction and civil engineering purposes. In recent years, nonwoven fabrics have been expanded and applied as interior/exterior materials for automobiles in accordance with the trend toward weight reduction in automobile materials. Further, a long fiber nonwoven fabric having a low weight while having the same strength as the interior material in the form of a conventionally used woven fabric or short-fiber nonwoven fabric is applied. The product groups that are mainly applied include tile carpets, automobile flooring carpets, under covers, head linear products, and the like.

For a long fiber nonwoven fabric, waste such as renewable polyester plastics is recycled, and thus, nonwoven fabrics containing recycled polyester raw materials, which have excellent basic physical properties of nonwoven fabrics such as tensile strength while contributing to resource recycling and prevention of environmental pollution, are being developed. Further, the use is expanding to nonwoven fabrics for filters, nonwoven fabrics for carpets, etc.

However, the use of recycled polyester raw materials may cause issues such as deterioration of characteristics (e.g., chip agglomeration, poor spinnability, and deterioration of nonwoven fabric physical properties, etc.) due to the differences in the chemical composition of additives and adhesives contained in nonwoven fabric waste, and the inclusion of a large amount of foreign matters.

DETAILED DESCRIPTION OF THE INVENTION

Technical Problem

It is one object of the present disclosure to provide a spunbonded nonwoven fabric that has excellent basic physical properties and is suitable for use as a base fabric for tile carpet by applying a recycled polyester raw material, which is made by recycling recyclable polyester plastic waste while having low foreign matter content and optimizing the physical properties of the raw material, and a method for manufacturing the same.

It is another object of the present disclosure to provide a tile carpet using the above-mentioned spunbond nonwoven fabric.

Technical Solution

Provided herein is a spunbonded nonwoven fabric including a fiber web of mixed filament yarns of a first filament composed of a recycled polyester having a melting point of 255° C. or more, and a second filament prepared from a copolyester having a melting point that is lower by 30° C. or more than that of the first filament, wherein the recycled polyester contains a recycled material of a waste polyester polymer obtained by using a monomer composition in which the ratio of diethylene glycol to ethylene glycol is 1.30 or less, and has an intrinsic viscosity (IV) of 0.60 to 0.80 dl/g, and a crystallization temperature of 175° C. or more and lower than 185° C.

Also provided herein is a tile carpet including the spunbonded nonwoven fabric as a base fabric.

Below, a spunbond nonwoven fabric that can be used as a base fabric for a tile carpet according to embodiments of the present disclosure, and a production method thereof, will be described in detail.

Prior to the description, unless otherwise specified throughout this specification, the technical terms used herein are only for reference to specific embodiments and is not intended to limit the present disclosure.

The singular forms "a", "an", and "the" used herein include plural references unless the context clearly dictates otherwise.

The term "including" or "comprising" as used herein specifies a specific feature, region, integer, step, action, element, and/or component, but does not exclude the presence or addition of a different specific feature, region, integer, step, action, element, component, and/or group.

Further, the terms including ordinal numbers such as "a first", "a second", etc. are used only for the purpose of distinguishing one component from another component, and are not limited by the ordinal numbers. For instance, a first component may be referred to as a second component, or similarly, the second component may be referred to as the first component, without departing from the scope of the present disclosure.

The present inventors have found that by optimizing the raw material physical properties of recycled materials when recycling waste such as renewable polyester plastics, while satisfying the basic physical properties such as sound absorption performance and withdrawal strength of tile carpets, it is possible to provide a spunbond nonwoven fabric having excellent basic characteristics of the nonwoven fabric and capable of cost reduction, thereby completing the present disclosure.

That is, even if the conventional recycled polyester raw material is used, deterioration of the characteristics are caused due to the inclusion of foreign matters such as additives and adhesives contained in the nonwoven waste, and thus, the purpose thereof is to solve such a problem.

Therefore, in the present disclosure, a spunbond nonwoven fabric having excellent basic characteristics of the nonwoven fabric is produced by applying a recycled polyester raw material having a low foreign matter content and improved physical properties of the raw material. Further, the spunbond nonwoven fabric according to the present disclosure can improve price competitiveness by recycling waste and reducing the raw material cost while having physical properties equal to or higher than those of the nonwoven fabric to which a pure polyester raw material is applied.

Now, the present invention will be described in detail.

Spunbond Nonwoven Fabric and Production Method Thereof

According to one embodiment of the present disclosure, there can be provided a spunbonded nonwoven fabric including a spunbonded nonwoven fabric including a fiber web of mixed filament yarns of a first filament composed of a recycled polyester having a melting point of 255° C. or more, and a second filament prepared from a copolyester having a melting point that is lower by 30° C. or more than that of the first filament, wherein the recycled polyester contains a recycled material of a waste polyester polymer obtained by using a monomer composition in which the ratio of diethylene glycol to ethylene glycol is 1.30 or less, and has an intrinsic viscosity (IV) of 0.60 to 0.80 dl/g, and a crystallization temperature of 175° C. or more and lower than 185° C.

The present disclosure relates to a method for producing a spunbond nonwoven fabric that optimizes the physical properties of the recycled polyester raw materials and thus is improved in spinnability and operability during production of spunbond nonwovens, and at the same time, has excellent mechanical properties such as tensile strength and tensile elongation.

Specifically, the present disclosure is characterized by using a recycled polyester raw material having a low foreign matter content and excellent physical properties. As the regenerated polyester raw material is optimized in crystallization temperature, the number of foreign matters, etc., in the case of a filament obtained using the recycled polyester raw material, a high-thickness nonwoven fabric can be provided without deterioration of physical properties. Therefore, the present disclosure provides a spunbond nonwoven fabric that can be used as a base fabric for finished tile carpets due to excellent mechanical properties such as room-temperature physical properties (tensile strength, tensile elongation) and a method for producing the same.

Specifically, the spunbond nonwoven fabric is provided by using a first filament containing the recycled polyester having the above-described physical properties in a certain content or more, and a second filament obtained from a copolyester raw material having a melting point that is lower by 30° C. or more than that of the first filament. Particularly, since the spunbond nonwoven fabric uses a recycled polyester raw material adjusted so as to minimize the average foreign matter content and have a certain range of crystallization temperature during the recycling of polyester waste, it exhibits the physical properties of the final spunbond nonwoven fabric at a level equal to or higher than that of the conventional one, thereby providing an excellent effect of cost reduction and price competitiveness.

In addition, when a pure polyester raw material is used as the first filament, a cost increase due to the provision of a pure raw material may occur even if a spunbond nonwoven fabric satisfying certain physical properties is provided. However, in the present disclosure, as the recycled raw material is used as the first filament, it is possible to provide a spunbond nonwoven fabric that not only has a cost-reducing effect but also satisfies physical properties equal to or higher than those of pure polyester.

Hereinafter, a spunbond nonwoven fabric according to an embodiment of the present disclosure will be described in more detail.

The spunbond nonwoven fabric includes two kinds of raw materials having different melting points as a first filament and a second filament.

Specifically, the spunbond nonwoven fabric can be provided by a fiber opening method after two types of filaments including a first filament composed of recycled polyester having a melting point of 255° C. or higher based on the total weight of the nonwoven fabric, and a second filament obtained from a copolyester raw material having a melting point of 220° C. or less form a web in the form of a conjugate spinning (Matrix & Binder).

In particular, the first filament includes a recycled polyester obtained by recycling waste of a recyclable polyester plastic, and can be composed of the recycled polyester raw material without the addition of other materials.

The raw material used to provide the recycled polyester is characterized by using a waste polyester polymer obtained using a monomer composition in which the monomer ratio of diethylene glycol to ethylene glycol is specifically adjusted to 1.3 or less among the monomers used in the preparation of the polyester polymer. The monomer ratio can be similarly maintained even in the recycled polyester raw material. Therefore, the ratio of diethylene glycol to ethylene glycol in the recycled polyester raw material may be 1.3 or less.

Further, the recycled polyester can use those recycled by optimizing physical properties so as to satisfy a specific crystallization temperature and intrinsic viscosity, and to minimize the average number of foreign matters.

That is, by recycling the waste polyester polymer in which the monomer ratio is adjusted, the physical properties of the raw material can be optimized and the content of foreign matters can be reduced as described above, whereby a spunbond nonwoven fabric having excellent basic characteristics of the nonwoven fabric such as spinnability, tensile strength, and tensile elongation can be provided. In particular, as the recycled polyester satisfying the above characteristic physical properties is used as the first filament, it is possible to provide a nonwoven fabric providing a cost reduction effect and having excellent price competitiveness while satisfying physical properties equivalent to or higher compared to non-woven fabrics to which pure polyester raw materials are applied.

Specifically, the intrinsic viscosity (IV) of the recycled polyester raw material contained in the first filament may be 0.60 to 0.80 dl/g. When the intrinsic viscosity of the recycled polyester is less than 0.60 dl/g, there is a drawback that the operability is inferior due to problems such as filament cutting, and the effect of improving the mechanical properties of the nonwoven fabric due to the production of the low-viscosity filament is insignificant. Further, if the intrinsic viscosity of the recycled polyester is 0.80 dl/g or more, excessive increases in extruder pressure and spinning nozzle pressure during the melt extrusion process can lead to process problems.

The ratio of diethylene glycol to ethylene glycol (DEG/EG) may be 1.3 or less, or 0.5 to 1.3, or 1.2 to 1.3. When the ratio is 1.3 or more, there are problems such as deterioration of physical properties of the final finished nonwoven fabric and nonuniformity of fineness due to a decrease in the crystallinity of the fiber as the amorphous region increases. Additionally, the monomer ratio may be 1.3 or less. If the ratio is too low (0.5 or less), the production reactivity of the polymer using the monomer is lowered, and the production of polyester may be impossible.

Further, the crystallization temperature may be 175° C. or more and 185° C. or less or 175° C. to 180° C. When the temperature is 175° C. or less, there is a problem that the fiber that is not sufficiently cooled in the process of cooling the fiber is drawn, which results in poor operability such as a sticky phenomenon. When the temperature is 185° C. or more, there is a problem in that the fibers are cut in the high-speed and high-pressure drawing process due to super-cooling.

Further, the average number of foreign matters having a size of 1.0 to 10.0 μm in the recycled polyester contained in the first filament may be 10 or fewer or 2 to 9. When the average number of foreign matters is 10 or more, a chip agglomeration phenomenon may occur, and the physical properties of the nonwoven fabric may be deteriorated due to poor spinnability.

Further, the ratio of diethylene glycol to ethylene glycol contained in the recycled polyester may be 1.30 or less. The recycled polyester raw material may include 10 or fewer average foreign matters having a size of 1.0 to 10.0 μm based on the total weight of the recycled polyester.

Thereby, in an embodiment of the present disclosure, the recycled polyester contained in the first filament similarly satisfies the conditions of an intrinsic viscosity (IV) of 0.60 to 0.80 dl/g and a crystallization temperature of 175° C. or more and less than 185° C. Further, as previously described, the recycled polyester may include a recycled material of a waste polyester polymer prepared using a monomer composition in which the ratio of diethylene glycol to ethylene glycol is 1.30 or less.

The spunbond nonwoven fabric may have a thickness of 0.35 mm to 0.40 mm when the weight per unit area is 90 $g/m^2$.

Therefore, according to the present specification, there can be provided a nonwoven fabric for a tile carpet base fabric that not only has excellent spinnability during the production of nonwoven fabrics and improves tensile strength and tensile elongation, but also has the effect of recycling waste such as polyester plastic and thus reducing costs by using the first filament including the recycled raw material and the second filament described later in a certain ratio, Meanwhile, as described above, the parameter physical properties can be achieved by adjusting the content range of the monomer for producing the polyester before recycling.

Specifically, the recycled polyester may be a well-known recycled raw material of waste polyester. For example, the recycled polyester may be a polyester copolymer including a post-industrial recycled (PIR) polyethylene terephthalate in the form of chips recycled from the waste in the well-known polyester production process, a post-consumer recycled (PCR) polyethylene terephthalate, or a mixture thereof. Further, these materials are recycled from waste polyester in which the ratio of diethylene glycol/ethylene glycol as described above is adjusted to 1.3 or less, and those satisfying not only the crystallization temperature and intrinsic viscosity, but also the physical property conditions including 10 or fewer average foreign matters can be used. The waste polyester may include a waste polyester such as a waste fiber or a waste container in which the ratio of diethylene glycol to ethylene glycol is 1.3 or less. Further, if the above materials have the monomer ratio adjusted, polyester copolymers recycled by methods well known in the art can be purchased and used.

Therefore, the first filament may contain a copolymer such as adipic acid (AA), isophthalic acid (IPA), neopentyl glycol (NPG), and butadiene (BD) depending on the recycled material.

As a specific example, the recycled polyester contained in the first filament may include a recycled raw material of the waste polyester copolymer of a dicarboxylic acid selected from the group consisting of terephthalic acid, adipic acid (AA), and isophthalic acid (IPA) and a diol compound selected from the group consisting of neopentyl glycol (NPG), diethylene glycol, and ethylene glycol.

In one illustrative embodiment, the dicarboxylic acid may be terephthalic acid and isophthalic acid, and the diol compound may be diethylene glycol and ethylene glycol. Therefore, the recycled polyester may be a recycled raw material for the waste polyester copolymer of the monomer composition that contains 45 to 75 parts by weight of isophthalic acid (IPA), 47 to 58 parts by weight of ethylene glycol (EG), and 69 to 74 parts by weight of diethylene glycol based on 100 parts by weight of terephthalic acid (TPA). In addition, the waste polyester copolymer may be a waste generated in the production process of polyester produced so that the ratio of diethylene glycol to ethylene glycol is 1.30 or less.

Therefore, the recycled polyester used as the first filament raw material may include a chip form recycled from the waste, and the recycled polymer raw material in the form of chips has the above-mentioned intrinsic viscosity (IV) of 0.60 to 0.80 dl/g, a crystallization temperature of 175° C. or more and less than 185° C., and an average number of foreign matters of 10 or fewer having a size of 1.0 to 10.0 μm based on the total weight of the recycled polyester.

In one illustrative embodiment, the recycled polyester contained in the first filament may be a recycled material of waste polyethylene terephthalate obtained using a monomer composition having an intrinsic viscosity (IV) of 0.60 to 0.80 dl/g, a crystallization temperature of 175° C. or more and less than 185° C., and a ratio of diethylene glycol to ethylene glycol of 1.30 or less, and may be a recycled polyethylene terephthalate having an average number of foreign matters of 10 or fewer having a size of 1.0 to 10.0 μm based on the total weight of the recycled polyethylene terephthalate. The polyethylene terephthalate may be a recycled raw material of a waste polyester polymer obtained by polymerizing 45 to 75 parts by weight of isophthalic acid (IPA), 47 to 58 parts by weight of ethylene glycol (EG), and 69 to 74 parts by weight of diethylene glycol based on 100 parts by weight of terephthalic acid (TPA), as described above.

Meanwhile, the filament spun in the form of conjugate spinning is sufficiently drawn so that the spinning speed becomes 4500 to 5500 m/min using a high-pressure air drawing device, so that it can be produced at a filament level having fineness of 5 to 10 denier in the case of a typical first filament, and fineness of 2 to 5 denier in the case of the second filament.

After the produced filament fiber is positioned in a web shape on a conveyor net, the thickness of the nonwoven fabric is adjusted through the calendering process of a heated smooth roll, and then a nonwoven fabric is produced by bonding using hot air of a temperature similar to the melting point of the second filament.

Specifically, the spunbond may be provided according to the following method.

In one illustrative embodiment, there can be provided a method for manufacturing the spunbond nonwoven fabric, the method including the steps of: a) performing conjugate spinning of a first filament prepared from polyester and recycled polyester each having a melting point of 255° C. or more and a second filament produced from a copolyester having a melting point that is lower by 30° C. or more than that of the first filament, and drawing the filaments to produce a mixed filament yarn; b) laminating the mixed filament yarn to form a fiber web; and c) subjecting the fiber web to a calendering process and heat-bonding.

The step a) performs the step of producing a mixed filament yarn using two types of filaments having different melting points.

More specifically, as the recycled polyester contained in the first filament, recycled polyethylene terephthalate chips having a melting point of 255° C. or more, an intrinsic viscosity (IV) of 0.60 to 0.80 dl/g, a crystallization temperature of 175° C. or more and less than 185° C., and an average number of foreign matters of 3 to 10 having a size of 1.0 to 10.0 μm can be used.

Such a recycled polyester is a recycled raw material that is obtained by recycling waste polyester obtained by using a monomer composition in which the ratio of diethylene glycol to ethylene glycol is 1.3 or less. In one example, the recycled polyester may use those in which the waste polyester produced in a ratio of diethylene glycol to ethylene glycol of 1.3 or less is pulverized, then put into an extruder, and melt-extruded to adjust the physical properties so as to have the intrinsic viscosity, crystallization temperature, and average number of foreign matters, thereby manufacturing in the form of chips. The pulverization size of the waste polyester is not particularly limited, and can be pulverized by a method well known in the art, and may further include a washing step before pulverization.

Further, the second filament may include a copolyester having a melting point that is lower by 30° C. or more than that of the first filament. Therefore, the second filament may use a copolyester having a melting point that is lower by 30° C. or more, or 160° C. or more and 180° C. or less than that of the first filament containing adipic acid (AA), isophthalic acid (IPA), neopentyl glycol (NPG), or a mixture thereof. However, the monomer constituting the copolyester is not limited to the above type, and it can be selected and used without limitation as long as it can provide a polyester copolymer having the specific melting point range.

The content ratio of the first filament and the second filament can be controlled by controlling the discharge amount of the molten polymer or by changing the design of the spinneret.

As an example, the mixed filament yarn may contain 50 to 95% by weight or 60 to 95% by weight or 80 to 95% by weight of the first filament; and 5 to 50% by weight or 5 to 40% by weight or 5 to 20% by weight of the second filament. For example, the content ratio of the first filament to the second filament may be 90:10% by weight.

Meanwhile, the process including b) a step of laminating the mixed filament yarn to form a fiber web, and c) a step of subjecting the fiber web to calendering process and heat-bonding, can be performed to provide a spunbonded nonwoven fabric.

As described above, the filament spun in the form of a conjugate spinning is sufficiently drawn so that the spinning speed is 4500 to 5500 m/min using a high-pressure air drawing device, so that in the case of the first filament, which is a recycled raw material, the filament can be configured to have fineness is 5 to 10 denier, and in the case of the second filament having a melting point than the first filament, the filament can be configured to have fineness of 2 to 5 denier.

The spunbond nonwoven fabric can be obtained using a spinning condition in which the pressure range of the spinning pack is 1600 to 2500 psi. When the spin pack pressure is less than 1600 psi, a phenomenon occurs in which the fibers do not come out straight, but the fibers break and come out, which may cause cutting of fibers (filaments). On the other hand, when the spinning pack pressure is 2500 psi or more, the pressure of the polymer inside the pack is too high to pass through the nozzle, and a pack leak phenomenon may occur in which the polymer is discharged to the outside. Therefore, the pressure range of the spinning pack needs to advance to the above range conditions to provide a spunbonded nonwoven fabric containing fibers (filaments) having a good shape and excellent quality without cutting.

In addition, the step of manufacturing the spunbond nonwoven includes a calendering process using a smooth roll and a hot air process at a temperature similar to or corresponding to the melting point of the second filament.

In one example, the filament fiber produced by the above method is positioned in the form of a web on a conveyor net, and then the thickness of the nonwoven fabric is adjusted through the calendering process of a heated smooth roll, and then a nonwoven fabric is produced by bonding using hot air at a temperature similar to the melting point of the second filament.

The calendering process can be performed at a temperature of 150 to 200° C., and the thickness of the nonwoven fabric can be adjusted by such a process. In one example, in the present disclosure, when the weight per unit area is 90 $g/m^2$, a calendering process can be performed so that the thickness of the spunbond is 0.35 mm to 0.40 mm.

The heat-bonding step can be performed under hot air conditions at a temperature of 0 to 10° C. higher than the melting point of the low melting point copolyester constituting the second filament. Therefore, the hot air process can be performed at a temperature corresponding to the melting point of the second filament, for example, in a range of 160° C. or more to 180° C. or less.

Tile Carpet

According to the method described above, a spunbond nonwoven fabric suitable for use as a base fabric for tile carpet can be provided. In addition, in the present disclosure, by using the spunbond nonwoven fabric as a base fabric for tile carpets, it is possible to provide a tile carpet with excellent sound absorption and tuft withdraw force.

In one illustrative embodiment, the spunbonded nonwoven fabric may have a tensile strength of 15 kg·f/5 cm or more, and a tensile elongation of 15% or more as measured according to the KS K ISO-9073-3 test method.

Therefore, according to another embodiment of the present disclosure, there can be provided a tile carpet that includes the spunbond nonwoven fabric having the above physical properties as a base fabric.

In the present disclosure, the nonwoven fabric provided by the above-mentioned method can be subjected to a tufting process, a back-coating process, and a cutting process according to a well-known method to provide a tile carpet.

According to one embodiment, the nonwoven fabric is subjected to a tufting process (process of planting threads in a non-woven fabric) on the surface of a loop type polypropylene BCF (bulky continuous filament) yarn of about 3000 De'/150 Fila. with a gauge (the needle interval is represented by INCH as a unit indicating the density of the needle in a tuft machine, and the density in the width direction of the TUFTED CARPET is determined by GAUGE) of about 1/10 and a stitch (density in a longitudinal direction of the tufted carpet) of about 10.5. Then, a nonwoven fabric composed of glass fibers having a unit weight of about 40 g/m$^2$ and a PVC solution of about 6.0 kg/m$^2$ is impregnated onto the back surface of the tufted nonwoven fabric. Then, the impregnated product is heat-cured in a thermal chamber at about 180° C., and finally subjected to a cutting process (standard: 50 cm×50 cm). Thereby, a high-performance finished product tile carpet having a tuft withdraw force (strength of pulling the loop after loop type tufting) of about 2.0 kgf can be manufactured.

Advantageous Effects

According to the present disclosure, by optimizing the physical properties (crystallization temperature, number of foreign matters) of the recycled polyester raw material during recycling of waste such as a recyclable polyester plastic, it is possible to produce nonwoven fabrics having superior price competitiveness such as cost reduction while having the same or higher level of physical characteristics than non-woven fabrics to which only pure polyester raw materials are applied. In addition, in the present disclosure, even if the recycled polyester raw material is used, a high-performance spunbond nonwoven fabric can be produced without chip agglomeration, poor spinnability, and deterioration of the nonwoven fabric physical properties as in the conventional case.

BRIEF DESCRIPTION OF THE STRETCHING

FIG. 1 shows the state (a) of a calender roll at the time of manufacturing a nonwoven fabric according to Comparative Example 3 and the result of a nonwoven fabric sheet surface (b).

DETAILED DESCRIPTION OF THE EMBODIMENTS

Hereinafter, the action and effect of the invention will be described in more detail with reference to specific examples of the invention. However, these examples are presented for illustrative purposes only and the scope of the invention is not limited thereby in any way.

[Preparation of Materials]

As the recycled polyester used as the first filament in the following examples, a recycled raw material in the form of chips (hereafter, recycled PET) recycled from waste of polyethylene terephthalate (PET) that was produced through esterification at a temperature of about 220 to 240° C. using a monomer composition containing 45 to 75 parts by weight of isophthalic acid (IPA), 47 to 58 parts by weight of ethylene glycol (EG), and 69 to 74 parts by weight of diethylene glycol based on 100 parts by weight of terephthalic acid (TPA) was used. The recycled chips of the recycled polyester were produced in the form of chips by pulverizing the polyethylene terephthalate waste, putting it in a twin-screw extruder, and melt-extruding it.

At this time, the recycled PET used the one in which the monomer content range was adjusted so as to satisfy the condition of a ratio of diethylene glycol to ethylene glycol (i.e., a ratio of diethylene glycol/ethylene glycol) in the range of 1.21:1 to 1.30:1, and an intrinsic viscosity 0.61 to 0.80 as shown in Table 1, and the average number of foreign matters having a size of 1.0 to 10.0 μm based on the total weight of the recycled PET was adjusted to 10 or fewer.

Further, the recycled PET used in comparative examples is a recycled raw material of PET waste produced by a method outside the above-mentioned monomer usage range, and as disclosed in Table 1, is a case where an intrinsic viscosity, a crystallization temperature, a ratio of diethylene glycol/ethylene glycol of waste, and the average number of foreign matters were deviated from the present configuration.

Example 1

A recycled polyester (recycled PET) having an intrinsic viscosity (IV) of 0.61 dl/g, a crystallization temperature of 176.5° C., a diethylene glycol/ethylene glycol ratio of 1.27, an average number of foreign matters of 5.6, and a melting point of 255° C. as the first filament, and a copolyester having a melting point of about 220° C. as a second filament were respectively melted using a continuous extruder at a spinning temperature of about 280° C., and then the discharge amount and the number of pores in the nozzle were adjusted so that the average fineness of the first filament prepared by conjugate-spinning and drawing the first filament and the second filament at the content ratio of 90:10 wt. % was 8.5 denier.

Then, the continuous filaments discharged from the capillaries were solidified with cooling air, and then drawn so that the spinning speed was 5000 m/min using a high-pressure air drawing device, thereby producing filament fibers. At this time, the pressure range of the spinning pack was the same as the conditions disclosed in Table 2.

Next, the produced filament fibers were laminated in the form of a web on a conveyor net by a conventional fiber opening method. The laminated web was subjected to a calendering process using a heated smooth roll to impart smoothness and an appropriate thickness.

The laminated filaments were thermally bonded at a hot air temperature of about 220° C. to produce a spunbond nonwoven fabric having a weight per unit area of 90 g/m$^2$ and a thickness degree (thickness) of 0.33 mm.

Example 2

A spunbond nonwoven fabric was produced in the same manner as in Example 1, except that a recycled polyester raw material (recycled PET) having an IV of 0.65 dl/g, a crystallization temperature of 175.8° C., a diethylene glycol/ethylene glycol ratio of 1.24, and an average number of foreign matters of 3.1 was applied as the first filament, and it was adjusted to the same thickness and weight per unit area.

Example 3

A spunbond nonwoven fabric was produced in the same manner as in Example 1, except that a recycled polyester raw material (recycled PET) having an IV of 0.73 dl/g, a crystallization temperature of 176.0° C., a diethylene glycol/ethylene glycol ratio of 1.21, and an average number of foreign matters of 2.7 was applied as the first filament, and it was adjusted at the same thickness and weight per unit area.

Example 4

A spunbond nonwoven fabric was produced in the same manner as in Example 1, except that a recycled polyester raw material (recycled PET) having an IV of 0.80 dl/g, a crystallization temperature of 176.3° C., a diethylene glycol/ethylene glycol ratio of 1.30, and an average number of foreign matters of 8.4 was applied as the first filament, and it was adjusted at the same thickness and weight per unit area.

Comparative Example 1

A spunbond nonwoven fabric was produced in the same manner as in Example 1, except that a recycled polyester raw material (recycled PET) having an IV of 0.55 dl/g, a crystallization temperature of 176.3° C., a diethylene glycol/ethylene glycol ratio of 1.27, and an average number of foreign matters of 5.1 was applied as the first filament, and it was adjusted at the same thickness and weight per unit area.

Comparative Example 2

A spunbond nonwoven fabric was produced in the same manner as in Example 1, except that a recycled polyester raw material (recycled PET) having an IV of 1.00 dl/g, a crystallization temperature of 175.9° C., a diethylene glycol/ethylene glycol ratio of 1.21, and an average number of foreign matters of 1.1 was applied as the first filament, and it was adjusted at the same thickness and weight per unit area.

Comparative Example 4

A spunbond nonwoven fabric was produced in the same manner as in Example 1, except that a recycled polyester raw material (recycled PET) having an IV of 0.68 dl/g, a crystallization temperature of 166.4° C., a diethylene glycol/ethylene glycol ratio of 1.22, and an average number of foreign matters of 2.9 was applied as the first filament, and it was adjusted at the same thickness and weight per unit area.

Reference Example 1

A spunbond nonwoven fabric was produced in the same manner as in Example 1, except that a recycled polyester raw material (recycled PET) having an IV of 0.75 dl/g, a crystallization temperature of 176.2° C., a diethylene glycol/ethylene glycol ratio of 1.37, and an average number of foreign matters of 12.4 was applied as the first filament, and it was adjusted at the same thickness and weight per unit area.

TABLE 1

| | Recycled polyester raw material | | | | |
|---|---|---|---|---|---|
| | Viscosity | | Crystallization | Diethylene | Average number of |
| Category | Intrinsic viscosity dl/g | Melting point (at 280° C.) Poise | temperature (Tc) ° C. | glycol/ethylene glycol ratio [DEG/EG] | foreign matters (1.0~10.0 μm) (개) |
| Example 1 | 0.61 | 984 | 176.1 | 1.27 | 5.6 |
| Example 2 | 0.65 | 1122 | 176.3 | 1.24 | 3.1 |
| Example 3 | 0.73 | 1478 | 176.5 | 1.21 | 2.7 |
| Example 4 | 0.80 | 1681 | 175.8 | 1.30 | 8.4 |
| Comparative Example 1 | 0.55 | 420 | 176.3 | 1.27 | 5.1 |
| Comparative Example 2 | 1.00 | 2410 | 175.9 | 1.21 | 1.1 |
| Comparative Example 3 | 0.68 | 1320 | 169.4 | 1.37 | 2.9 |
| Reference Example 1 | 0.75 | 1514 | 176.2 | 1.21 | 12.4 |

Experimental Example

The physical properties of the examples and comparative examples were measured according to the following measurement methods for each evaluation item, and the results are shown in Table 2 below.

Experimental Example 1: Spinnability (Pack Pressure)

A pressure measurement sensor (model name: TB422J-9/18-231) available from Dynisco was used.

Specifically, a sensor for measuring the spinning pack pressure was installed on the rear end side of the gear pump, and the pack pressure was confirmed when the polymer was inserted at the pack pressure and discharged. The normal pack pressure management range was 1600 to 2500 psi.

Experimental Example 2: Tensile Strength (kgf/5 cm) and Tensile Elongation (%)

KS K ISO-9073-3 (Cut Strip) test method was used.

Specifically, a specimen having a size of width×length=5 cm×20 cm was clamped with an upper/lower 5 cm×5 cm jig using an Instron testing machine, and then it was measured at a tensile speed of 200 mm/min.

Experimental Example 3: Measurement of Filament Detachment and Number of Times of Cutting Filaments During 24-hour observation, the number of cutting filaments and the number of cop detachments were measured.

TABLE 2

| Category | Spinnability (Pack pressure) (Psi) | Tensile strength (kg · f/5 cm) (MD/CD) | Tensile elongation (%) (MD/CD) | Final evaluation |
|---|---|---|---|---|
| Example 1 | 1678 | 17.2/18.6 | 20.1/20.8 | ○ |
| Example 2 | 1823 | 19.8/20.4 | 21.8/22.6 | ○ |
| Example 3 | 2209 | 23.4/23.6 | 22.1/24.9 | ○ |
| Example 4 | 2461 | 25.8/26.1 | 24.2/26.8 | ○ |
| Comparative Example 1 | 1011 | Impossible to spin due to filament cutting | | x |
| Comparative Example 2 | 3084 | Impossible to spin due to leakage caused by excessive pack pressure | | x |
| Comparative Example 3 | 1907 | Calendar roll stick phenomenon and sheet quality failure caused by undrawn yarn (FIG. 1) | | x |
| Reference Example 1 | 2328 | Filament detachment and multiple cutting filaments, impossible to spin due to cop detachment | | x |

Looking at the results of Table 2, it was confirmed that in Examples 1 to 4 of the present disclosure, as the intrinsic viscosity, crystallization temperature, diethylene glycol/ethylene glycol ratio, and average number of foreign matters are all specified for the first filament (recycled polyester raw material), the spinnability was excellent and both the tensile strength and tensile elongation were excellent as compared with Comparative Examples 1 to 3 and Reference Example 1.

On the other hand, in Comparative Example 1, the intrinsic viscosity of the first filament was lower than the range of the present disclosure, and thus, the spinnability was low, and spinning was impossible due to cutting filaments, whereby the tensile strength and tensile elongation could not be measured. In Comparative Example 2, the intrinsic viscosity of the first filament was too high compared to the range of the present disclosure, and thus the pressure of the spinning pack was excessively increased, whereby it was impossible to spin due to leakage.

In addition, Comparative Example 3 and Reference Example 1 were included in the normal spinning pack pressure management range, but the crystallization temperature of the first filament was too low or the content of foreign matters was high as compared with the present disclosure, whereby it was difficult to measure the physical properties. In particular, as shown in FIG. 1, Comparative Example 3 exhibited a severe sticky phenomenon of the calender roll during production of the nonwoven fabric (FIG. 1 (*a*)). Looking at the appearance of the nonwoven fabric surface resulting therefrom, sheet quality defects due to the undrawn yarn occurred (FIG. 1 (*b*)) occurred. In Comparative Example 4, a large number of filament detachments and filament cutting occurred, and spinning due to the cop detachment was impossible, whereby the tensile strength and tensile elongation could not be measured.

The invention claimed is:

1. A spunbonded nonwoven fabric having a fiber web and heat-bonded form using filament yarns of a first filament composed of a recycled polyester having a melting point of 255° C. or more, and a second filament prepared from a copolyester having a melting point that is lower by 30° C. or more than that of the first filament, wherein the recycled polyester contains a recycled material of a waste polyester polymer obtained by using a monomer composition in which a ratio of diethylene glycol to ethylene glycol is 1.30 or less, and has an intrinsic viscosity (IV) of 0.60 to 0.80 dl/g, and a crystallization temperature of 175° C. or more and lower than 185° C.

2. The spunbonded nonwoven fabric according to claim 1, wherein the recycled polyester comprises a recycled material of the waste polyester polymer of the monomer composition that contains 45 to 75 parts by weight of isophthalic acid (IPA), 47 to 58 parts by weight of ethylene glycol (EG), and 69 to 74 parts by weight of diethylene glycol based on 100 parts by weight of terephthalic acid (TPA).

3. The spunbonded nonwoven fabric according to claim 1, wherein the mixed filament yarn contains 50 to 95% by weight of the first filament and 5 to 50% by weight of the second filament.

4. The spunbonded nonwoven fabric according to claim 1, wherein the first filament is a filament having average fineness of 5 to 10 denier, and the second filament is a filament having average fineness of 2 to 5 denier.

5. The spunbonded nonwoven fabric according to claim 1, wherein the spunbonded nonwoven fabric has a thickness of 0.35 mm to 0.40 mm when the weight per unit area is 90 g/m$^2$.

6. The spunbonded nonwoven fabric according to claim 1, which is obtained under spinning conditions where a pressure range of a spinning pack is 1600 to 2500 psi.

7. The spunbonded nonwoven fabric according to claim 1, wherein the spunbonded nonwoven fabric has a tensile strength of 15 kg·f/5 cm or more, and a tensile elongation of 15% or more, as measured according to the KS K ISO-9073-3 test method.

8. A tile carpet comprising the spunbonded nonwoven fabric according to claim 1.

* * * * *